United States Patent [19]

Sigott et al.

[11] 4,020,640

[45] May 3, 1977

[54] SHIELD STRUCTURE

[75] Inventors: Siegfried Sigott; Alfred Zitz; Heinrich Suessenbeck, all of Zeltweg, Austria

[73] Assignee: Vereinigte Osterreichische Eisen- und Stahlwerke-Alpine Montan Aktiengesellschaft, Vienna, Austria

[22] Filed: Aug. 17, 1976

[21] Appl. No.: 715,202

[30] Foreign Application Priority Data

Sept. 26, 1975 Austria ..... 7392/75

[52] U.S. Cl. ..... 61/45 D; 248/357

[51] Int. Cl.[2] ..... E21D 15/44

[58] Field of Search ..... 61/45 D; 299/31–33; 248/357; 91/170 MP

[56] References Cited

UNITED STATES PATENTS

| | | | |
|---|---|---|---|
| 3,885,396 | 5/1975 | Snowden et al. | 61/45 D |
| 3,898,845 | 8/1975 | Plevak et al. | 61/45 D |
| 3,902,325 | 9/1975 | Sigott et al. | 61/45 D |
| 3,915,500 | 10/1975 | Schlusener et al. | 299/32 |
| 3,959,976 | 1/1976 | Blumenthal | 248/357 |

FOREIGN PATENTS OR APPLICATIONS

| | | | |
|---|---|---|---|
| 2,319,909 | 11/1974 | Germany | 61/45 D |

*Primary Examiner*—Dennis L. Taylor
*Attorney, Agent, or Firm*—Cushman, Darby & Cushman

[57] ABSTRACT

The invention relates to a shield structure particularly adapted for longwall mining providing a protected area that effectively insures operator safety even if total collapse of the mine roof should occur. The prop supporting the load-bearing cap of the shield is inclined rearwardly with respect to the mine face, and a pair of tension links that are pivotally connected to each other and are acted upon by a hydraulic cylinder in a direction transverse to the tension links, provide a structure which will ensure a widened (though shorter) protected area in which an operator may reside even upon complete roof collapse. The widening of the area helps insure that any fallen material from the roof will not harm an operator in the protected area.

4 Claims, 3 Drawing Figures

SHIELD STRUCTURE

BACKGROUND AND SUMMARY OF THE INVENTION

U.S. Pat. No. 3,902,325 of applicant refers to a mine roof support and shield structure for the face support in mines, comprising a base frame, a shield pivotally connected to said base frame and supported against this base frame by at least one prop, and at least one load-bearing rocking cap pivotally connected to said shield, noting that at least one load-bearing hinged cap is pivotally connected to said shield and that the pivotal point of the rocking cap or caps is, as seen in a top-plan view, located behind the front edge, facing the mine face, of the base frame, and noting that the pivotal point of the rocking cap, the pivotal point of the hinged cap and preferably also the point of attack of the prop or props supporting the shield structure are adjacent one another, and further noting that the shield is pivotally connected to the base frame with interposition of at least one link, the position of which link is defined by at least one strut being variable in length and acting, on the one hand, on the base frame, and, on the other hand, on the link, on the shield or on the joint connecting the link with the shield. Such a mine support and shield structure provides a good support for the mine roof and allows to support the roof of a seam by means of the hinged cap with a sufficient supporting force immediately after exposing the roof.

However, particularly with higher levels of the roof of the seam, i.e., with higher longwalls, there exists the danger that fractures occuring at the mine face will endanger the working path in the area of the longwall and persons present there, i.e., in front of the props.

The present invention aims at avoiding the mentioned deficiency of a construction according to the above-mentioned patent and essentially consists in that the prop is inclined in rearward direction and that the strut of variable length is formed of two tension links being mutually pivotally connected, the pivotal joint of that tension links being acted upon by a hydraulic cylinder-piston-means in transverse direction to said tension links, said cylinder-piston-means being supported against the base frame at the side of the tension links being opposed to the props. In view of the prop or the props being inclined in rearward direction, the lower supporting point of the prop can be advanced with the upper supporting point of the prop remaining in unchanged position. In view of this feature and in view of two mutually connected tension links being provided which are acted upon by the hydraulic cylinder-piston-means at the side opposed to the props, the space between said strut of variable length and the prop is increased such that the working path is kept free for persons staying within the longwall. This working path is now covered at its top side by the shield and by the rearward portion of the rocking cap, and is rearwardly located to such an extent that it cannot be endangered by any inroad occuring either at the mine roof or at the mine face or at the mine filling side.

In case of a rock burst, the roof of the exploitation area may suddenly sink to the lowermost position of the shield and of the cap. In view of the strut of variable length being formed of two mutually connected tension links and in view of the piston-cylinder-means acting on the connecting joint of these tension links at the side opposite to the props and in view of said piston-cylinder-means being pressure loaded, the piston is shifted into the cylinder in the case mentioned. The tension links nearly assume a stretched position, i.e., the distance between said tension links and the prop is increased. Therefore, in case of such a complete downward movement of the prop, the space between the tension links and the prop is not being narrowed but widened, so that also in such a case a sufficiently shielded operating path remains between the prop and the tension links, and accidents can be avoided. Thus, the invention provides for increased safety in mining.

According to a preferred embodiment of the invention the shield may be vaulted or kinked in outward direction and the cylinder-piston-means supporting the rocking cap against the shield can be arranged before the prop. In this manner, the free cross-section of the working path being located between the prop and the strut of variable length can be increased. By vaulting or kinking the shield in outward direction the free space is of increased height. By increasing the height of the area adjacent the supporting point of the prop and by arranging the hydraulic cylinder-piston-means before the props, this cross-section of increased height of the working path is kept free of installations.

The invention is further illustrated with reference to the drawing, which schematically shows an embodiment of a mine roof support and shield structure according to the invention.

DETAILED DESCRIPTION OF THE INVENTION

Figure 1:
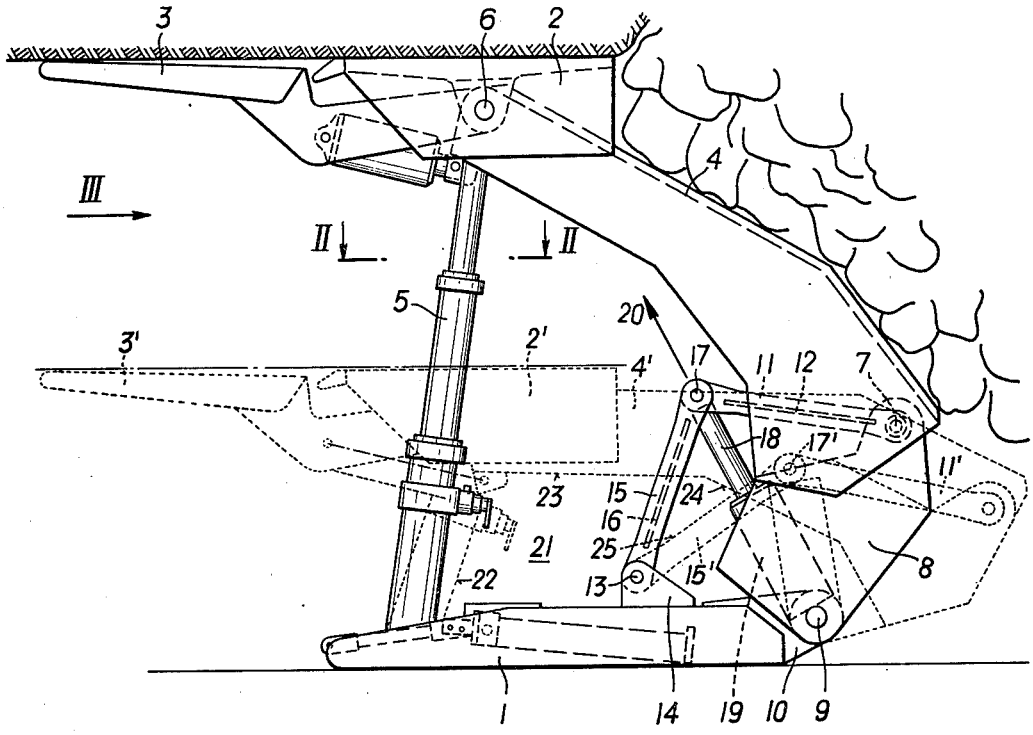
FIG. 1 represents an exploitation area in a side elevation.
Figure 2:
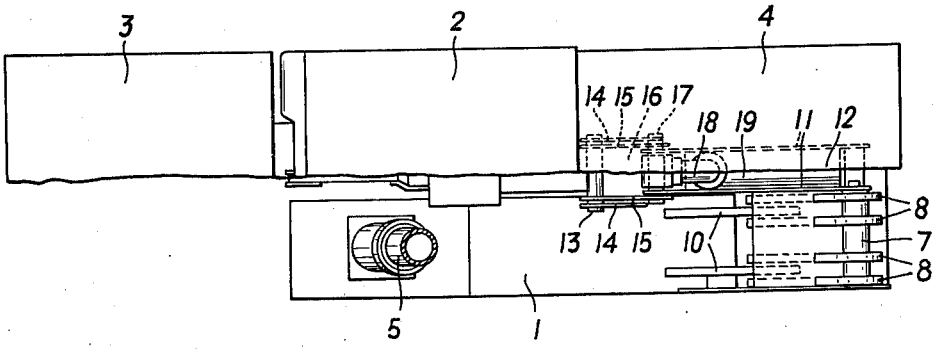
FIG. 2 represents, partially in a section along line II — II of FIG. 1, a top plan view with the shield, the rocking cap and the hinged cap being removed.

1 is the base frame, 2 is the rocking cap, 3 is the hinged cap, 4 is the shield. 5 are hydraulic props, which are pivotally connected to the base frame 1. The props 5 act on an axis 6 to which are pivotally connected the shield 4, the rocking cap 2 and the hinged cap 3. The shield 4 is subdivided into two shield halves, which are pivotally connected to rocker plates 8 by means of two shafts 7. The rocker plates 8 are pivotally connected by means of shaft 9 to lashings 10 being fixed to the base frame 1. Guide rods 11 are acting on shafts 7 connecting the rocker plates 8 and both halves of the shield 4. The guide rods 11, which are coordinated to said two shield halves, are connected with one another by means of a stiffening plate 12. A second pair of guide rods 15 is pivotally connected to lashings 14 of the base frame 1 by means of a shaft 13, noting that again both guide rods 15, which are coordinated to said both halves of the shield 4, are mutually connected by means of a plate 16. Both pairs of guide rods 11 and 15 are mutually pivotally connected by means of a shaft 17, to which the piston 18 of a hydraulic cylinder-piston-means 18, 19 is pivotally connected. The cylinder 19 of this cylinder-piston-means 18, 19 is pivotally connected to shaft 9.

If the working space of the piston 18 is subjected to pressure, the piston will urge the pivotal joint 17 in the direction of arrow 20. The guide rod pairs 11, 15 are pulling shaft 7 in left-hand direction. This movement is effected on lifting movement of the hydraulic props 5.

The hydraulic props 5 are inclined in rearward direction, i.e., in right-hand direction as seen in FIG. 1, so that the working path 21 between the props 5 and the guide rods 15 becomes relatively wide.

If on account of a rock burst the exploitation area, together with the hinged cap 2, the rocking cap 3 and the shield 4, should completely sink down, the prop will assume position 2′ shown in dashed lines. The shield 4 will be pressed in a downward direction and shaft 7 will be moved in right-hand direction into position 7′ shown in dashed lines. Thereby, the piston 18 of the hydraulic cylinder-piston-means 18, 19 will be completely retracted. Shaft 17 is moved into position 17′ shown in dashed lines. The piston 19 is moved into position 19′ shown in dashed lines, and the guide rods 11 and 15 are moved into positions 11′ and 15′ shown in dashed lines. The pressed-down position of the cap 2 is designated 2′ and the pressed-down position of the shield 4 is designated 4′. Thus it is obvious that even in completely pressed-down position, which only occurs in case of a very severe rock burst, a working path, bordered by the dashed lines 22, 23, 24 and 25, is kept free, the height of which will now be reduced, but the width of which will be increased. This working path as bordered by the lines 22, 23, 24 and 25 is quite sufficient for protecting an operator, so that the working path provides sufficient safety also in case of a rock burst.

Figure 3:
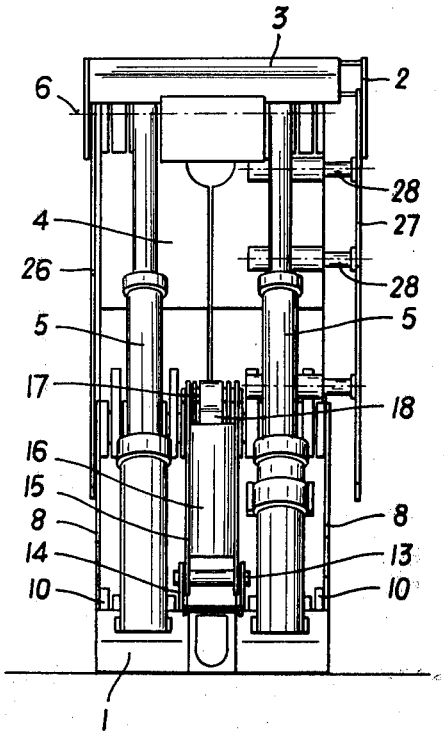
FIG. 3 represents a view in direction of arrow III of FIG. 1.

In the mine the shield jacks are closely arranged one beside the other and the side shields 26 and 27 of adjacent shield jacks are contacting one another. Therefore, the side shield 27 (FIG. 3) is a yielding shield which is connected to the shield 4 by means of resilient telescoping rods 28.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What we claim is:

1. Mine roof support and shield structure for the face support in mines, comprising a base frame, a shield pivotally connected to said base frame and supported against this base frame by at least one prop, and at least one load-bearing rocking cap pivotally connected to said shield, noting that at least one load-bearing hinged cap is pivotally connected to said shield and that the pivotal point of the rocking cap or caps is, as seen in a top-plan view, located behind the front edge, facing the mine face, of the base frame, and noting that the pivotal point of the rocking cap, the pivotal point of the hinged cap and preferably also the point of attack of the prop or props supporting the shield structure are adjacent one another, and further noting that the shield is pivotally connected to the base frame with interposition of at least one link, the position of which link is defined by at least one strut being variable in length and acting, on the one hand, on the base frame, and, on the other hand, on the link, on the shield or on the joint connecting the link with the shield, characterized in that the prop is inclined in rearward direction and that the strut of variable length is formed of two tension links being mutually pivotally connected, the pivotal joint of that tension links being acted upon by a hydraulic cylinder-piston-means in transverse direction to said tension links, said cylinder-piston-means being supported against the base frame at the side of the tension links being opposed to the props.

2. Mine roof support and shield structure for the face support in mines according to claim 1, characterized in that the shield is vaulted or kinked in outward direction.

3. Mine roof support and shield structure for the face support in mines according to claim 1, characterized in that a cylinder-piston-means supporting the rocking cap against the shield is arranged before the prop.

4. A mine roof support and shield structure as recited in claim 2 further comprising a cylinder-piston-means for supporting the rocking cap against the shield, said means disposed in front of the prop with respect to the mine face.

* * * * *